United States Patent [19]

Minnetti

[11] 4,336,875

[45] Jun. 29, 1982

[54] APPARATUS FOR THE TRANSFER OF HANKS

[75] Inventor: Federico Minnetti, Pieve a Nievole, Italy

[73] Assignee: Officine Minnetti di Ornella Reveggi & C. S.A.S., Colonna, Italy

[21] Appl. No.: 154,030

[22] Filed: May 28, 1980

[30] Foreign Application Priority Data

Jun. 1, 1979 [IT] Italy ..... 23219 A/79
Jul. 23, 1979 [IT] Italy ..... 24561 A/79

[51] Int. Cl.[3] ..... B65G 25/04

[52] U.S. Cl. ..... 198/486; 198/652; 198/653

[58] Field of Search ..... 198/471, 477, 482, 483, 198/484, 486, 487, 678, 680, 681, 796, 652, 653; 68/168; 28/287

[56] References Cited

U.S. PATENT DOCUMENTS 1,812,789 6/1931 Hurxthal et al. ..... 198/681
3,139,966 7/1964 Sheets et al. .
3,388,815 6/1968 Lingl ..... 198/486 X
3,710,711 1/1973 Boehm et al. ..... 198/482 X
4,162,600 7/1979 Westall et al. .

FOREIGN PATENT DOCUMENTS 1216229 5/1966 Fed. Rep. of Germany .
1216230 5/1966 Fed. Rep. of Germany .
2148474 4/1973 Fed. Rep. of Germany .
2649471 3/1975 Fed. Rep. of Germany .
1405144 5/1965 France .
2211919 7/1974 France .

*Primary Examiner*—James L. Rowland
*Attorney, Agent, or Firm*—Fleit & Jacobson

[57] ABSTRACT

An apparatus for transferring yarns in hanks from hank carriers or supports movable along a feeding line to a container or conveyor device comprises a head (40) movable in at least one direction parallel with the extension of the hank holding supports (11) and preferably movable also parallel with the feeding of the hank holders; the head carries at least one pliers member (50) comprising two parallel rods (51, 52) cantilevered and movable between a spread apart position and a position close to each other.

21 Claims, 7 Drawing Figures

APPARATUS FOR THE TRANSFER OF HANKS

This application is concerned with the field of plants or systems for the treatment of yarns, and particularly relates to the transfer of yarns from one location to another of a plant, that is from the hank holding or hank carrier supports containing the same to other supports, or on belt conveyors, carriages or to other machines, such as packaging machines, etc.

In the plants or systems for yarn treatment, wherein the yarns are caused to pass through the plant in the form of hanks, it is required at several locations of the plant to shift the hanks from one support to another; particularly, at the outlet from a yarn drying furnace following, for example, a dyeing station, it is required to withdraw the hanks coming out of the furnace, which hanks are carried on hank holding supports, and arrange such hanks on a carriage or belt conveyor or other transporting member, for supply to further processings or directly to packaging. Generally, such hank holding supports comprise metal arms bent to form a horizontal bearing portion for one or more threaded hanks and are carried on a moving chain. This transfer of the hanks from the moving hank holding supports to another transporting member or other hank holding supports is generally manually carried out and on one hand has as a result the disadvantage of a high cost, and on the other hand the disadvantage of being a troublesome, repetitive and heavy work.

A further problem in hank transport or transfer resides in the necessity of avoiding tangles in the yarns maintaining a correct disposition of the hank during handling thereof.

Therefore, the goal was sought for mechanizing and automating the so-called hank transfer operation in order to reduce the costs therein involved. This has been accomplished by the apparatus of the present invention, comprising a head movable at least in one direction transversely of the direction of movement for the hank holders; the head carries at least one hank gripping pliers member; said pliers member comprises two parallel rods, cantilever carried by respective rotating supporting elements, allowing an opening or spreading movement of the pliers member rods and a closing or approaching movement thereof. The opening position enables the pliers member rods to be arranged at side by side relationship at the opposite sides of a hank dependent from a hank holding support; the closing position enables the rods to be tightened on the hank, so as to hold it during a translational movement thereof transversely of the moving or sliding line of the hank holders, allowing them to remove the hank from the relevant support.

According to this invention, a movement of the head parallel with the sliding direction of the hank holders can be obtained either by supporting the heads on a carriage sliding on a fixed framework, or by supporting the heads on a framework movable parallel to said sliding direction.

Preferably, each of the heads carries two side by side pliers, generally spaced apart from each other by the same spacing as the spacing between adjacent hank holders or by a multiple thereof; and according to this invention, a plurality of apparatuses may operate in cascade on a same line of movement for the hanks. The hanks gripped by the pliers may be unloaded on a belt conveyor or conveyor carriage for supply to next processing stations, or are unloaded directly in packaging machines. Otherwise, the hanks may be transferred from a first hank holding support conveyor to a second hank holding support conveyor.

Namely, in a particularly useful embodiment for transferring hanks from hank holding supports to container or transporting devices, the apparatus according to the invention comprises a fixed framework provided with sliding guides parallel to the sliding line of the hank holding supports; a carriage movable on said sliding guides and carrying further sliding guides transverse to said first guides; and a pliers holding head movable on said further guides and carrying one or more pliers.

In another embodiment particularly useful for the transfer of hanks from moving hank holding supports to other hank holding supports, an apparatus according to the invention comprises a fixed base structure carrying sliding guides parallel to the feeding direction of the hank holding supports; a movable slide applied onto said sliding guides and carrying further sliding guides transverse to the feeding direction of the hank holding supports; a framework movable on said further sliding guides and, in turn, carrying still further sliding guides parallel to said further sliding guides; and a carriage movable on the last mentioned further sliding guides and carrying one or more pliers.

The movements for the head, carriage and/or framework and slide, as well as the pliers opening and closing movement can be given by any known mechanical, electromechanical or pneumatic device.

The apparatus of this invention has the advantage of enabling a complete mechanization and automation of the hank transfer or unloading operation in a smooth and rapid manner, without causing any tangle in the yarn, while being a compact assembly of minimum overall size.

Hereinafter, some presently preferred embodiments of the invention will be described by mere way of unrestrictive example with reference to the accompanying drawings, in which.

Figure 1:
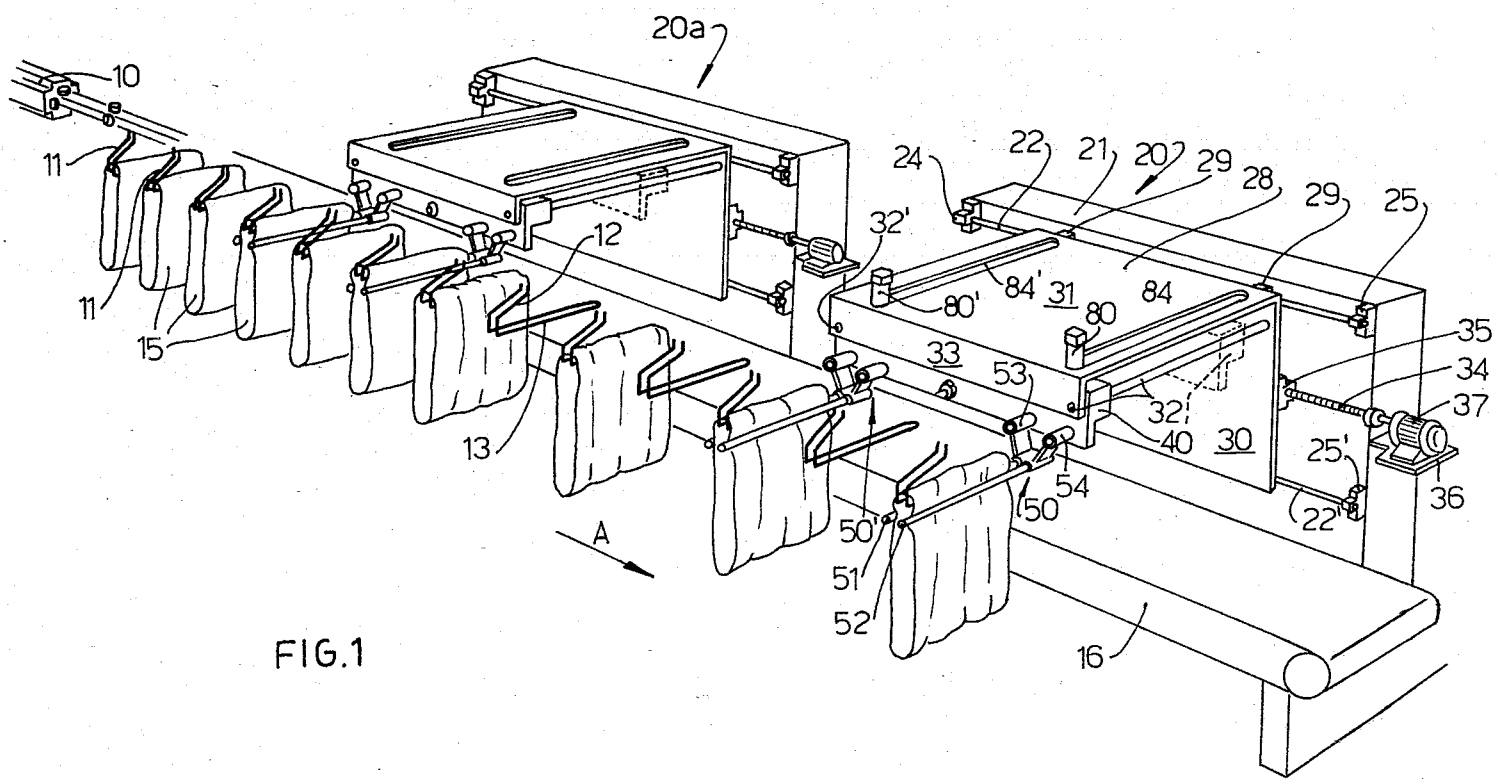
FIG. 1 is a perspective view showing a first type of plant of system using two devices according to this invention along a sliding line of hank holding supports.

Referring to FIG. 1, a rail 10, for instance outcoming from a drying furnace (not shown), carries a plurality of hank holding supports 11 driven by a continuously moving chain and regularly spaced apart there along. Said rail 10 is shown in a broken away view for a better illustration of the underlying details. The hank holding supports 11 are of a widely used known type and comprise an upper arm 12 for attachment to the rail and a horizontally extended lower section 13, generally formed of two metal rods which are generally parallel and spaced apart from each other. On the horizontal section 13 each of said supports 11 carries one or more dependent hanks 15.

These hanks 15 have to be removed from the respective support and placed on a conveyor means, container or packaging machine. Particularly in FIGS. 1 and 2 the hanks have to be laid on a belt 16 running parallel with the sliding line of the hank holding supports.

A hank transfer apparatus or device according to the present application, designated as a whole at 20 in FIG. 1, comprises a substantially vertical frame 21 in side by side relationship to said belt 16 at the opposite side to said rail 10 and carrying sliding bars 22, 22' parallel with said rail 10, that is substantially horizontal.

Each of the sliding bars 22, 22' are secured to the frame by end brackets, such as 24, 25, 25'. Of course, instead of the sliding bars, sliding guides of different shape could be provided.

A carriage 28 is slidably supported on bars 22, 22' by supports 29, this carriage being of angle shape as laterally seen, with one side 30 arranged along the frame 21 and the other side 31 orthogonal and sufficiently extended from said side 30 to straddle or step over said belt 16. The movement to carriage 28 is imparted by a screw 34 meshing in a nut screw 35; the screw is driven by a reducing motion variator 37 on a bracket 36.

Figure 2:
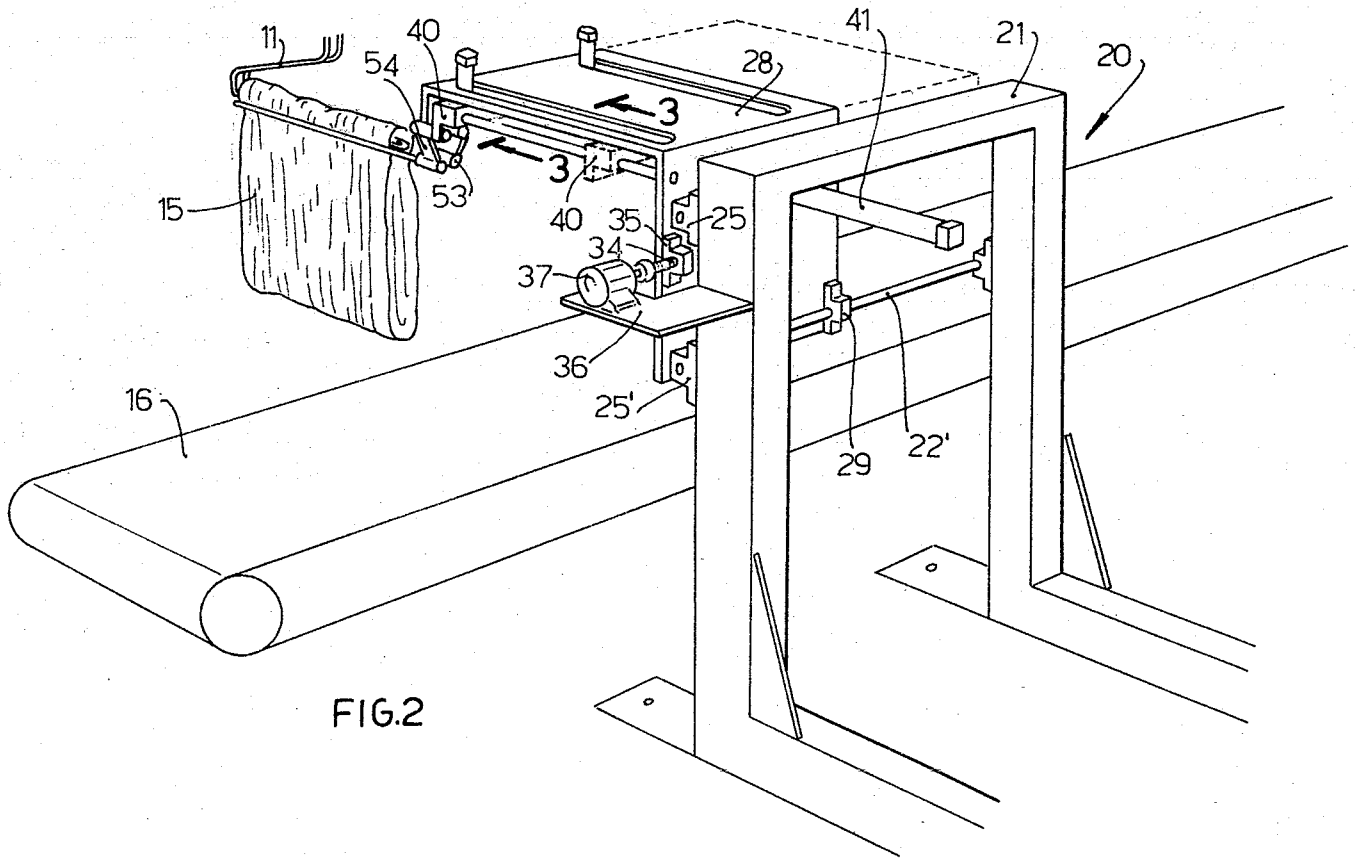
FIG. 2 is a perspective view of the plant or system shown in FIG. 1, showing only one apparatus or device, and from a different point of view with respect to FIG. 1.

Second sliding bars 32, 32', transverse to said chain 10, that is substantially perpendicular to said sliding bars 22, 22' on frame 21, are secured on said carriage 28 between the vertical side 30 thereof and a flange 33 at the outer end of side 31. On these bars 32, 32' (of which bar 32' is shown only by its end face) a head 40 is slidable, as controlled by a cylinder-piston unit 41 (FIG. 2).

Figure 6:
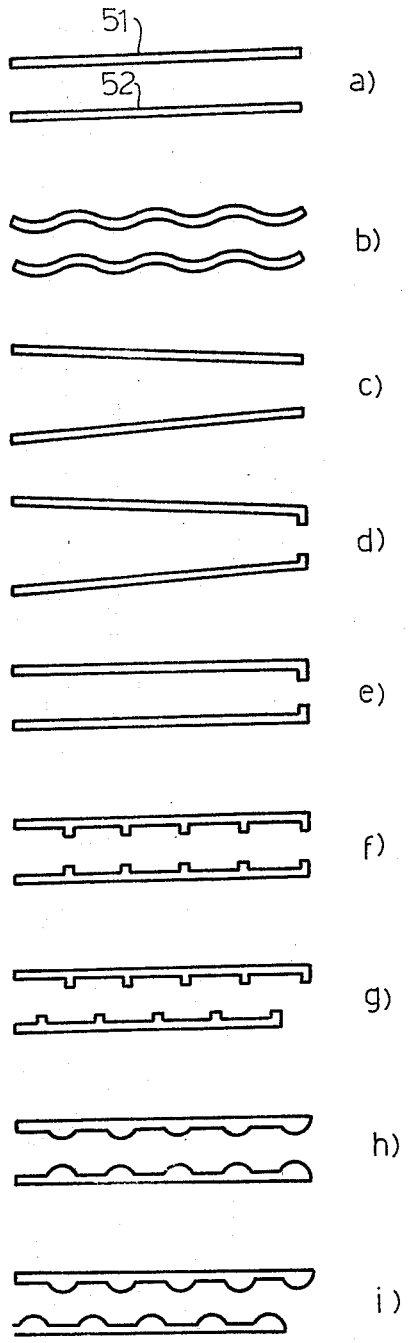
FIG. 6 is a view showing various forms contemplated for the gripping rods of the apparatus or device.

Said head 40 carries two identical gripping units or "pliers" 50, 50', so that the description will be given with reference only to unit 50. Each of the pliers 50 comprises two extended rods 51, 52, respectively, and each rod is carried in an arm 53, 54 rotably mounted on head 40, so that said rods 51, 52 are allowed to effect a mutual spreading or opening movement to be arranged on either side of a dependent hank, and a mutual approaching or closing or gripping movement to grip the hank therebetween and thereby remove it from the hank holding support. The rods 51, 52 may be made of different materials, for example plate or structural shapes of square, rectangular, triangular, rounds, tubular section or any other section. They may have various configurations in a plan view and some presently preferred but unrestrictive configurations are shown in FIG. 6, where at (a) a pair of parallel smooth rods is shown; at (b) a pair of sinusoidally shaped rods is shown; at (c) a pair of smooth inclined rods is shown; at (d) a pair of inclined rods with a final bending is shown; at (e) a pair of parallel rods with a final bending is shown; at (f) a pair of comb rods with facing teeth at corresponding positions is shown; at (g) a pair of comb rods with alternating facing teeth is shown; at (h) a pair of rods with corresponding facing half-round reliefs is shown; and at (i) a pair of rods with alternating facing half-round reliefs is shown. Said rods 51, 52 may also be covered with antifriction material or have a roughened surface.

The shape of the rods may vary depending on the types and size of the yarn, count and hank.

Figure 3:
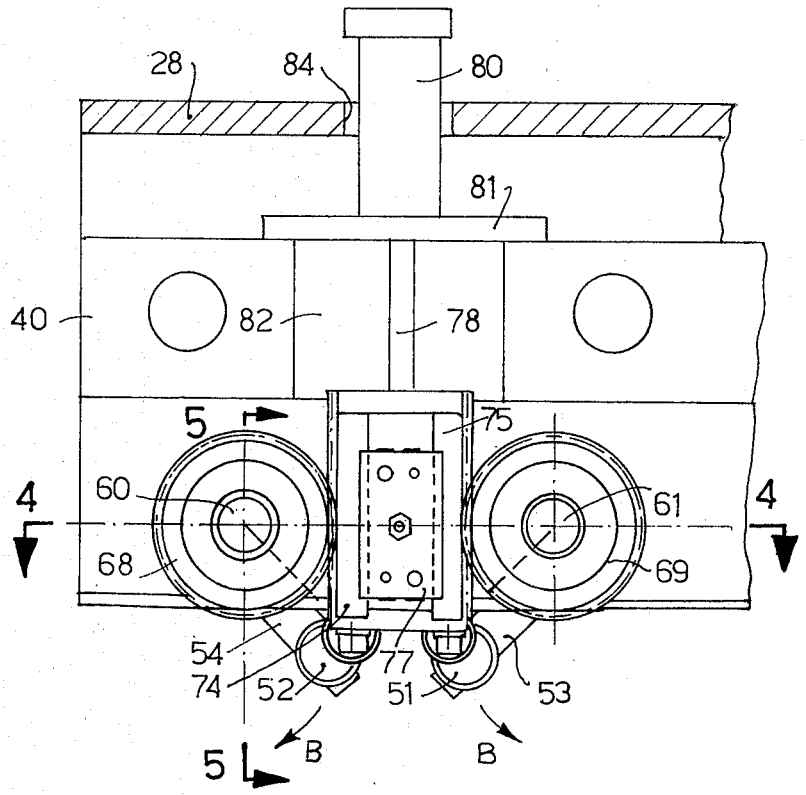
FIG. 3 is a broken away sectional view on enlarged scale taken along line 3—3 of FIG. 2.
Figure 4:
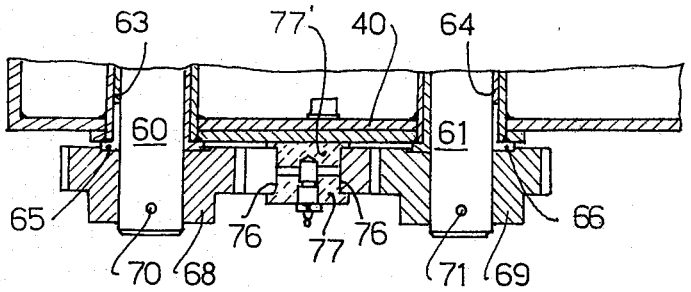
FIG. 4 is a broken away sectional view taken along line 4—4 of FIG. 3.
Figure 5:
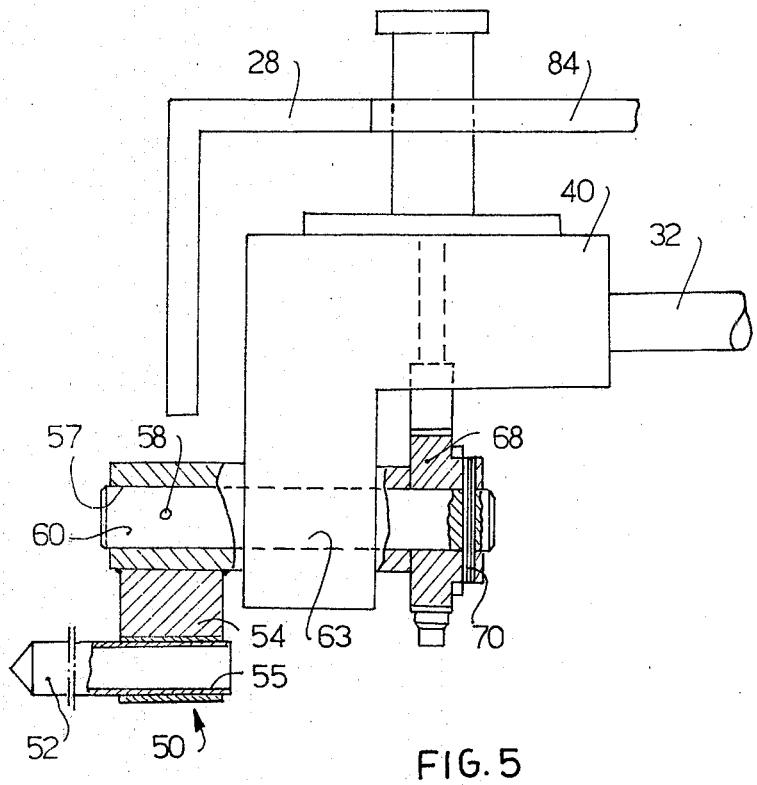
FIG. 5 is a partly sectional view as seen form the left with respect to FIG. 3, the view being taken along line 5—5.

A presently preferred but unrestrictive way for providing the opening and closing movements for pliers 50 is shown in FIGS. 3, 4 and 5. Each rod 52 or 51 has one end threaded and held clamped in a hole 55 of one end of arm 54 or 53. At the other end, each arm 54 or 53 has an eyelet 57, having secured therein by a pin 58 the end of a spindle 60 or 61, respectively. The latter is rotatably carried in a through hole 63 or 64, respectively, by bushes 65 or 66 in the head 40 and at the end opposite to said mentioned first end carries a gear 68 or 69 secured by a pin 70 or 71. Each gear 68 or 69 meshes with a respective rack 74, 75. In FIG. 3 the racks are vertically slidable interconnected and movable in a seating provided between two shaped and integral plates 77, 77'. In FIG. 3 the rods 51, 52 are shown at gripping position; a downward movement of the racks would widen them out according to arrows B. Said racks 74 and 75 are driven by a stem 78 of a cylinder-piston unit 80, stationary portion of which is mounted on head 40 by a plate 81. The stem 78 extends in an opening 82 of the head. Due to the overall size of cylinder 80, generally in the horizontal portion 31 of carriage 28 a slot 84 is formed for the movement of the cylinder integrally with said head 40.

The foregoing description in connection with pliers unit 50 is also true for pliers unit 50' which in FIGS. 1 and 2 is shown as applied onto said head 40, and for which some elements have been indicated by the same reference numerals as for unit 50, but followed by an apex. Of course, it is within the scope of this invention to provide heads having one, two or more pliers units spaced apart from one another.

The operation of the apparatus or device 20 will now be briefly described. Initially, the carriage 28 is on the sliding bars 22, 22' at a position at the left in FIG. 1, not shown. Thereon the head 40 is at retracted position.

The retracted position for said head 40 is shown by dashed lines in FIGS. 1 and 2.

Therein, the pliers rods (not shown in order not to unduly complicate the drawings) are widened out or spreaded as, for example, the racks 74, 75 at lowered position relative to FIG. 3 have caused the gears 68, 69 to rotate through a determined arc. The pliers are released or unloaded. The cylinder-piston unit 41 controls the feeding of head 40 carrying the pliers, still with the rods at spreaded position, to the advanced position shown by full line in FIGS. 1 and 2. Thus, the rods 51 and 52 will be arranged on either side of a hank 15 dependent from a support 11, the latter generally slowly moving according to arrow A of FIG. 1. Then, the cylinder-piston unit 80 moves said racks 74, 75 to approach or close the rods, the latter thus gripping the hank. The cylinder-piston unit 41 then controls the backward movement of head 40, whereby the closed rods 51 and 52 remove or unthread said hank 15 from its support 11.

Since the hank holding support 11 moves during these steps, the reducing motion variator or motor 37 causes a forward movement of said carriage 28 and associated elements which is parallel to and at the same speed as that of the supports 11. When the removed or unthreaded hank 15 has to be laid down on the belt 16 (or carriage or other element) and the pliers 50 are at the correct position, the cylinder 80 opens said rods 51, 52 and the hank falls down on belt 16.

Obviously, pliers 50' operate similarly as and simultaneously with pliers 50. Another apparatus or device **20*a* is shown in FIG. 1 is mounted along the same line of hank holding supports and operating in the same manner as the above described apparatus or device 20**, whereby it was not deemed necessary to apply all of the reference numerals thereto.

According to this application, it was thought suitable to have two devices 20, 20*a* operating in cascade and offset, that is on four subsequent hanks on a chain. One device will withdraw the first and third hanks, and the other device will withdraw the second and fourth hanks. The apparatus or device 20 could also be provided with a single capability of movement for the pliers, along the bars at right angles to the feeding direction of the hank holding supports, where a stepwise movement for the member carrying the hank holding supports is provided.

Figure 7:
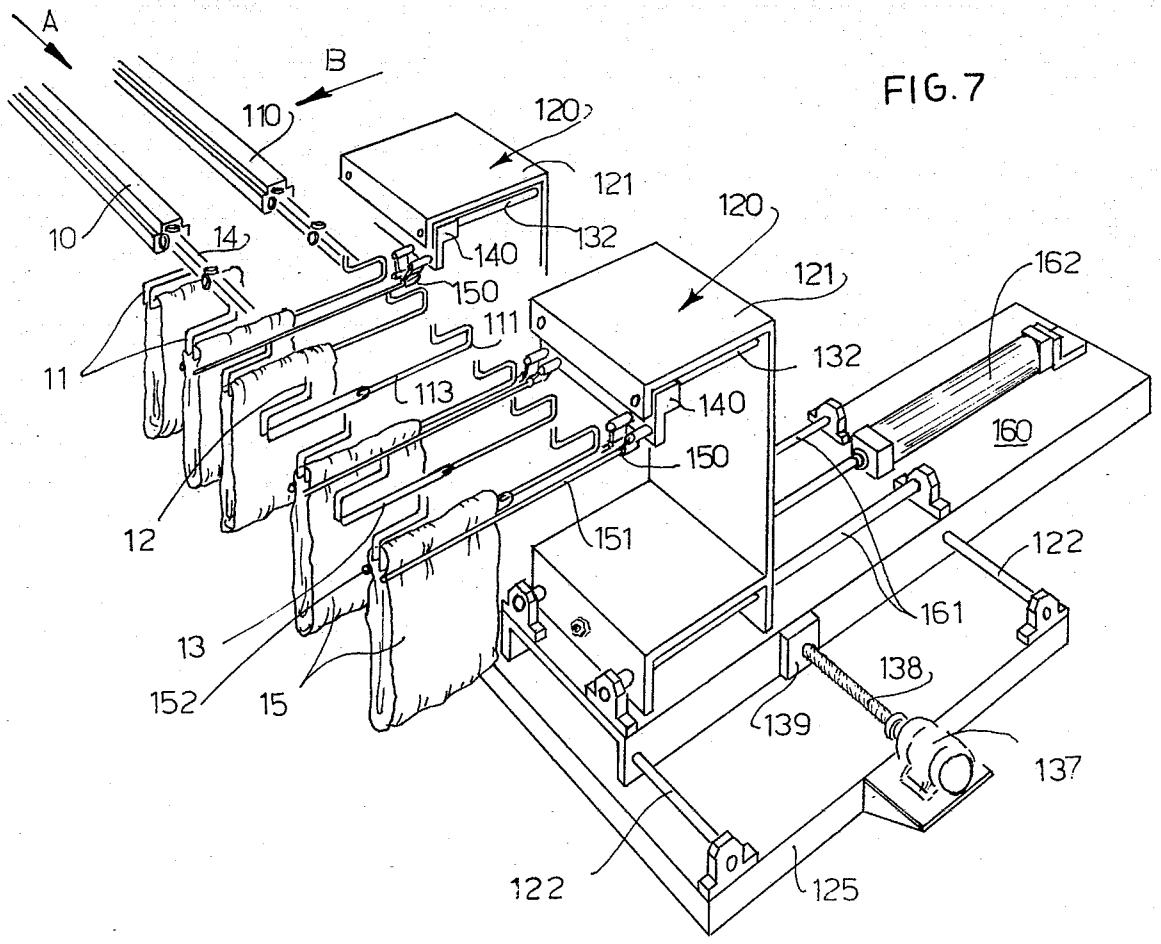
FIG. 7 is a diagrammatic perspective view of two hank transporting chains having two hank transfer devices coupled thereto, according to a second type of embodiment.

FIG. 7 shows an embodiment of the apparatus or device which is particularly suitable for hank transfer between hank holders of two moving chains.

Again, reference numeral 10 designates as a whole the first conveyor or chain and 11 the hank holding supports connected thereto. The relative chain 14 has been broken away for better showing the supports on which the hanks 15 are mounted. Said supports 11 comprise an upper section 12 and a horizontal lower section 13. A second conveyor 110 having supports 111 runs parallel with the first conveyor and is synchronized so that the planar portion 113 of hank holding supports connected thereto is arranged on the extension of the planar portion for the supports of the first conveyor.

The timing means between the two chains 10 and 110 are of any known type and operate so that the chains run substantially at the same speed in the direction of arrow A, with one support on the extension of the other (as above stated). In the figure of the drawings laterally of these two parallel conveyors there are provided, for example, two hank transfer devices 120, each of which comprise a frame 121 sliding in transverse direction to said conveyors 10 and 110 on guides 161. The latter are integral with a slide 160 which, in turn, slides on guides or bars 122 on a fixed bed plate 125. This enables a longitudinal movement of frame 121 in the moving direction of conveyors 10 and 110. This movement is provided by the motion variator or speed changer 137 by means of a screw and nut screw system 138, 139.

The transverse movement of frame 121 is provided, for example, by a pneumatic piston 162. Said frame 121 carries bars 132 transverse to said chains 10 and 110 and substantially parallel with said guides 161. The head 140 moves on said guides or bars 132 in the direction of arrow B as operated, for example, by a pneumatic piston not shown. This head 140 carries one or more pliers units 150, similar to units 50 described in connection with the first embodiment, but preferably with the rods 151, 152 more extended, generally extended as the two aligned hank holding supports.

The operation is as follows. The two parallel arranged conveyors 10 and 110 are synchronized to each other. At starting position, the frames 121 are positioned at the extreme position of end of stroke opposite to the direction of arrow A; the pliers are arranged clear of the path of the hank holding supports of conveyors 10 and 110 and the carriages at the extreme position of start of stroke opposite to the direction of arrow B. When desiring to commence the transfer from conveyor 10 to conveyor 110, the slide 160 is moved in the direction of arrow A at the same speed as the conveyors, while simultaneously transversely feeding the pliers, so that said head 140 is brought to end of stroke in the direction of arrow B, as well as said carriage 121, then the pliers are operated and grip or clamp the hanks as described for the preceding embodiment.

The accompanying figure of the drawings was just represented at this working or operating position.

For hank transfer from conveyor 10 to conveyor 110, it is only sufficient that both of the control pistons for said head and frame are retracted, so that said hanks 15 move on the supports 113 of conveyor 110. Obviously, the control pistons for head 140 and frame 121 may be simultaneously operated, or one piston may be first operated and the other just after operated. In the meanwhile, said slide 160 will continue to move in timing relationship with the movement of the conveyors and in the same direction as the latter.

The cycle terminates when the slide 160 is moved back to the starting position by said motor variator or speed changer 137. As apparent, only one device 120, or two or more than two of such devices can be used. Several pliers units, as offset or continuously arranged could be provided on a single transfer device.

The same transfer apparatus or device 120 can be used for transferring the hanks from conveyor 110 to conveyor 10 by merely modifying the control cycle, without any change in the apparatus or device.

The present invention includes all of those detail changes or modifications which may become apparent to those skilled in the art.

What is claimed is:

1. A device for hank transfer from hank holding supports movable along a feeding line to a containing or transporting device, each of the hank holding supports having a generally horizontally extending portion for supporting a hank, said device comprising: a head with at least one pliers member formed of a pair of rods extended substantially parallel with an extension of the horizontally extending portion of the hank holding supports, said rods being movable between a widened out or opening position and an approached closing or gripping position; means for controlling the movement of said rods between said opening and closing positions; and means for displacing said head with pliers at least in a direction parallel with an extension of the horizontally extending portion of the hank holding supports so that said rods in said opening position are positionable on opposite sides of a hank supported on one of said hank holding supports and are thereafter movable to said closing position to grip the hank so that the hank is removable from said holding support by displacement of said head away from the hank holding support.

2. A device according to claim 1, further comprising means for moving said head in a direction parallel with the feeding of said hank holding supports.

3. A device according to claim 1, wherein said means for controlling the movement of said rods comprises two spindles, a supporting arm for one of the rods integral with each spindle, said spindles being rotatably mounted on said head, gear wheels each integral with one of said spindles, each gear wheel meshing with a respective rack sliding on the head.

4. A device according to claim 3, wherein said racks move as a unitary body.

5. A device according to claim 1, wherein said means for displacing said head comprises first sliding guides extending parallel with the extension of the horizontally extending portion of the hank holding supports for guiding movement of said head, carriage means for carrying said first sliding guides, and said device including second sliding guides extending parallel with the feeding of the hank holding supports for guiding movement of said carriage means, and fixed frame means for carrying said second sliding guides.

6. A device according to claim 1, wherein said means for displacing said head comprises first sliding guides extending parallel with the extension of the horizontally extending portion of the hank holding supports for guiding movement of said head, and frame means for carrying the first sliding guides; said device including second sliding guides extending parallel with said first sliding guides for guiding movement of said frame means and slide means for carrying said second sliding guides; said fixed sliding guide means extending parallel with the direction of movement of said hank holding supports for guiding movement of said slide means.

7. A device according to claim 3, wherein said means for controlling movement of said rods comprises a cylinder-piston unit mounted on said head and having a movable member connected to said racks.

8. A device according to claim 1, wherein said means for displacing said head comprises a cylinder-piston unit.

9. A device according to claim 2, wherein said means for moving said head comprises a reducing motion variator or speed changer enabling a feed movement of said head at the same speed as the movement of the hank holding supports.

10. A device according to claim 1, comprising on a single head two pliers spaced apart from each other by the same spacing as that between successive hank holding supports.

11. A device according to claim 1, wherein said rods are parallel with one another.

12. A device according to claim 1, wherein said rods are convergent.

13. A device according to claim 1, wherein said rods have reliefs or teeth facing along the extension thereof.

14. A device according to claim 1, wherein said rods have a terminal bending.

15. A device according to claim 1, wherein said rods have a curvilinear shape.

16. A device according to claim 1 for hank transfer between hank holding supports of two facing chains, characterized by comprising means for synchronizing the chain movements and for ensuring the alignment of respective hank holding supports.

17. A device according to claim 1, wherein said rods substantially extend in the same direction as the hank supporting portion in a hank holding support.

18. A device according to claim 1, wherein said rods substantially extend as two aligned hank holding supports.

19. A device according to claim 1, comprising on a single head two pliers spaced apart from each other by a multiple of the spacing between successive hank holding supports.

20. A device for transferring hanks from hank holding supports moving in a feeding direction, said hank holding supports having a horizontally extending portion supporting the hanks, said device comprising:

a pair of rods movable with respect to each other between a spaced apart position and a gripping position in which the distance between the rods is less than the width of a hank carried by one of said hank holding supports;

means for controlling movement of said rods between said spaced apart position and said gripping position;

head means for supporting said rods and said means for controlling movement of said rods; and first movement means for moving said head means to and fro in a first direction parallel to an extension of said horizontally extending portion of said hank holding supports so that said rods in said spaced apart position are located on opposite sides of a hank supported on one of said hank holding supports and so that said rods after being moved to said gripping position are moved away from the hank holding support to thereby transfer the hank.

21. A device according to claim 20, further comprising second movement means for moving said head means in a second direction parallel to said feeding direction so that hanks are removable from said hank holding supports while said supports are moving.

* * * * *